US010193263B2

(12) United States Patent
Nagasaka et al.

(10) Patent No.: US 10,193,263 B2
(45) Date of Patent: Jan. 29, 2019

(54) CONNECTOR

(71) Applicant: YAZAKI CORPORATION, Tokyo (JP)

(72) Inventors: Naokazu Nagasaka, Shizuoka (JP); Jerico Constantino Cando, Shizuoka (JP); Elaine Diwa Italia, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/989,293

(22) Filed: May 25, 2018

(65) Prior Publication Data

US 2018/0351279 A1 Dec. 6, 2018

(30) Foreign Application Priority Data

May 31, 2017 (JP) ..... 2017-107519

(51) Int. Cl.

| | |
|---|---|
| ***H01R 13/40*** | (2006.01) |
| ***H01R 13/422*** | (2006.01) |
| ***H01R 13/627*** | (2006.01) |
| *H01R 13/11* | (2006.01) |

(52) U.S. Cl.

CPC ..... *H01R 13/4223* (2013.01); *H01R 13/6271* (2013.01); *H01R 13/113* (2013.01)

(58) Field of Classification Search

CPC ..... H01R 13/4223; H01R 13/6271; H01R 13/113

USPC ..... 439/595, 871

See application file for complete search history.

(56) References Cited

U.S. PATENT DOCUMENTS

| | | | | |
|---|---|---|---|---|
| 8,506,328 | B2 * | 8/2013 | Mizutani | H01R 13/113 439/595 |
| 8,764,496 | B2 * | 7/2014 | Todo | H01R 13/641 439/595 |
| 8,858,259 | B2 | 10/2014 | Chikusa et al. | |
| 2005/0095909 | A1 * | 5/2005 | Fukatsu | H01R 13/4361 439/595 |
| 2006/0172595 | A1 * | 8/2006 | Noro | H01R 13/4223 439/595 |

(Continued)

FOREIGN PATENT DOCUMENTS

JP 2013206667 A 10/2013

*Primary Examiner* — Abdullah A Riyami
*Assistant Examiner* — Nelson R. Burgos-Guntin
(74) *Attorney, Agent, or Firm* — Metrolexis Law Group, PLLC

(57) ABSTRACT

A connector includes a housing provided with a terminal chamber, a terminal accommodated in the terminal chamber and having a terminal-connecting portion and a wire-connecting portion, and a locking lance flexibly provided in the terminal chamber and having a locking portion. A plate portion is provided in the terminal-connecting portion. A hole portion is provided in the plate portion. An engagement surface to be engaged with the locking portion is provided on an edge portion of the hole portion. Chamfered portions are provided at edges of the hole portion on both sides of the engagement surface, and are inclined toward an inside of the hole portion. Supplemental engagement surfaces to be engaged with the locking portion in a detachment direction of the terminal from the terminal chamber are provided at parts of the engagement surface where the chamfered portions are located.

2 Claims, 10 Drawing Sheets

(56) References Cited

U.S. PATENT DOCUMENTS

| | | | | |
|---|---|---|---|---|
| 2007/0149050 | A1* | 6/2007 | Oka | H01R 13/03<br>439/595 |
| 2009/0186524 | A1* | 7/2009 | Maesoba | H01R 13/4223<br>439/595 |
| 2013/0065436 | A1* | 3/2013 | Hirabayashi | H01R 13/113<br>439/595 |
| 2013/0260599 | A1* | 10/2013 | Chikusa | H01R 13/6271<br>439/357 |

* cited by examiner

CONNECTOR

CROSS REFERENCE TO RELATED APPLICATIONS

The present application claims priority to Japanese Patent Application No. 2017-107519 filed on May 31, 2017, the entire contents of which are incorporated by reference herein.

BACKGROUND.

1. Technical Field

The present invention relates to a connector, and more particularly to a connector having a locking lance for locking a terminal accommodated in a terminal chamber.

2. Description of the Related Art

As a conventional connector, there has been known a connector including a housing having a terminal chamber, a terminal-connecting portion accommodated in the terminal chamber and connected to an opponent terminal, a wire-connecting portion connected to an end of the electric wire drawn out of the housing, and a locking lance flexibly (bendably) provided in the terminal chamber and having a locking portion on a free end side of the locking lance configured to lock the terminal-connecting portion (see JP 2013-206667 A (Patent Literature 1)).

In this connector, the terminal includes a bottom surface as a plate portion provided in the terminal-connecting portion and disposed facing the locking lance, a locking hole as a hole portion provided in the bottom surface and into which the locking portion can be inserted, an engagement surface provided at an edge of the locking hole facing against an insertion direction of the terminal and is configured to be engaged with the locking portion in a detachment direction of the terminal from the terminal chamber.

In such a connector, when a tensile force is applied to the electric wire, the bottom surface at the edge portion of the locking hole of the terminal comes into contact with the restriction portion provided in the locking portion of the locking lance, whereby the locking lance holds (maintains) a shearing area by an engagement of the locking portion of the locking lance with the engagement surface of the terminal.

SUMMARY

Incidentally, in the connector as disclosed in Patent Literature 1, the plate portions at the edge portions of the hole portions positioned on both sides of the engagement surface of the terminal are formed into flat surfaces.

In such a connector, it is required to increase (gain) the contact area (i.e. shearing area) between the locking portion of the locking lance to be inserted into the hole portion and the engagement surface engaged with the locking portion. However, the edge portion of the hole portion could not be expanded because it should be maintained to prevent the locking lance from an unexpected warpage of the locking lance. Therefore, the contact area could only be increased in the deflection direction of the locking lance.

Accordingly, it is impossible to sufficiently secure the contact area between the engaging portion of the locking lance and the engagement surface of the terminal, and there is a possibility that the locking portion may be damaged by the shearing force due to the tension of the electric wire, and thus a terminal holding ability in the terminal chamber may be reduced.

An object of the present invention provides a connector capable of improving a terminal holding ability in a terminal chamber.

An aspect of the present invention is a connector including: a housing provided with a terminal chamber; a terminal including a terminal-connecting portion and a wire-connecting portion, the terminal-connecting portion accommodated in the terminal chamber and configured to connect with an opponent terminal, the wire-connecting portion configured to connect with an end of an electric wire drawn out from the housing to an outside of the housing; a locking lance flexibly provided in the terminal chamber, the locking lance including a locking portion on a free end side of the locking lance, the locking portion configured to lock the terminal-connecting portion; a plate portion provided in the terminal-connecting portion, and arranged facing the locking lance; a hole portion formed in the plate portion, configured to receive the locking portion thereinto; an engagement surface provided at an edge of the hole portion facing against an insertion direction of the terminal to the terminal chamber, the engagement surface configured to be engaged with the locking portion in a detachment direction of the terminal from the terminal chamber; a pair of chamfered portions provided at edges of the hole portion on both sides of the engagement surface, the chamfered portions inclined toward an inside of the hole portion; and a pair of supplemental engagement surfaces provided at parts of the engagement surface where the pair of chamfered portions is located, the supplemental engagement surfaces configured to be engaged with the locking portion in the detachment direction of the terminal from the terminal chamber.

The plate portion may be provided with a locking projection projecting toward a locking lance side, and the locking projection may be provided with a projecting-engagement surface where the engagement surface is located, the projecting-engagement surface being engaged with the locking portion in the detachment direction of the terminal from the terminal chamber.

According to the present invention, it is possible to provide a connector capable of improving a terminal holding ability in a terminal chamber.

DESCRIPTION OF THE EMBODIMENTS

Figure 1:
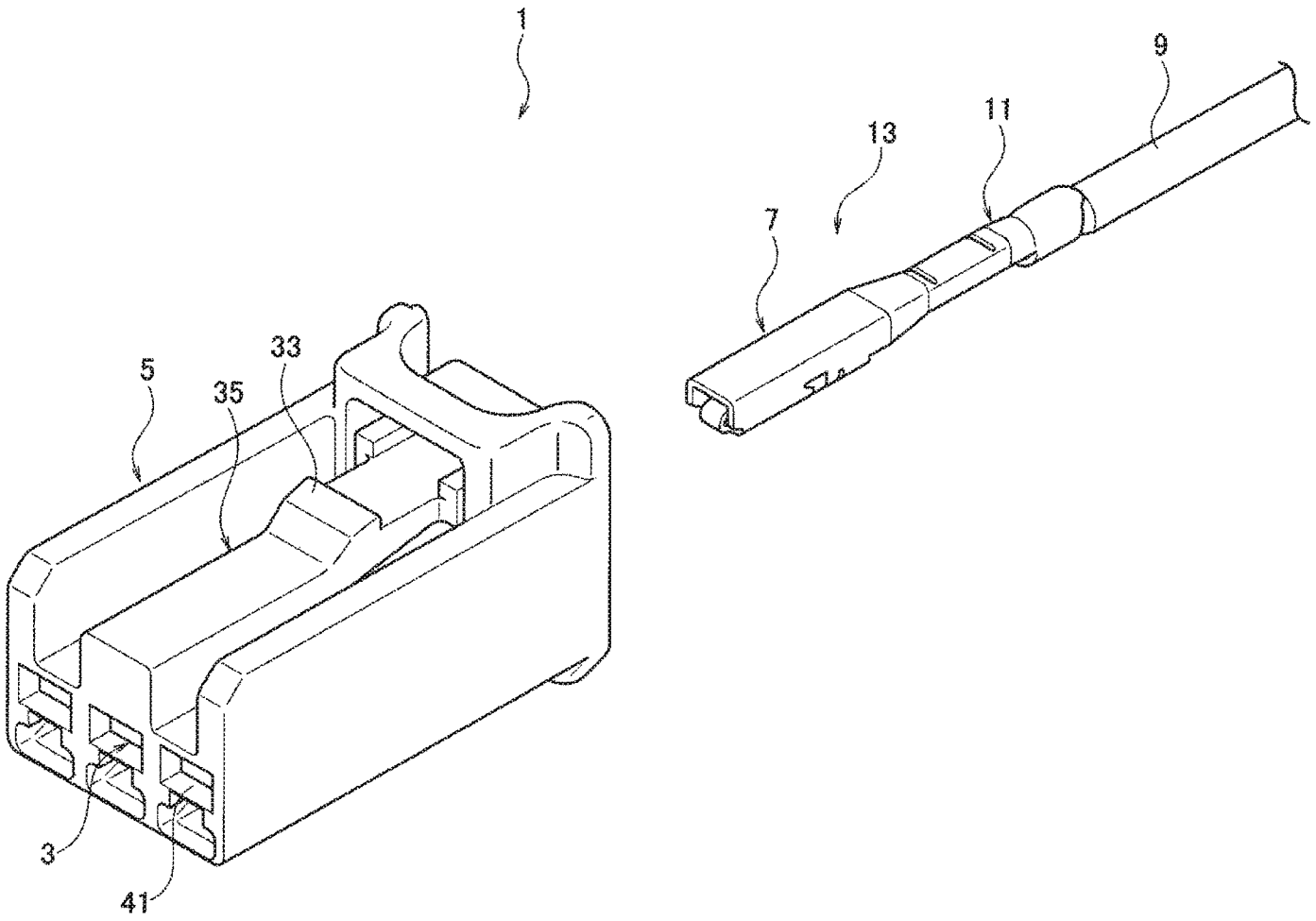
FIG. 1 is an exploded perspective view of a connector according to an embodiment of the present invention.

A connector according to an embodiment of the present invention will be described with reference to FIGS. 1 to 10.

A connector 1 according to the present embodiment includes a housing 5, a terminal 13, and a locking lance 17. The housing 5 is with a terminal chamber 3. The terminal. 13 includes a terminal-connecting portion 7 and a wire-connecting portion 11. The terminal-connecting portion 7 is accommodated in the terminal chamber 3, and is connected to an opponent terminal. The wire-connecting portion 11 is connected to an end of an electric wire 9 drawn out of the housing 5. The locking lance 17 is flexibly (bendably) provided in the terminal chamber 3. The locking lance 17 includes a locking portion 15 on a free end side of the locking lance 17. The locking portion 15 is configured to lock the terminal-connecting portion 7.

The terminal-connecting portion 7 is provided with a plate portion 19 disposed facing the locking lance 17. The plate portion 19 is provided with a hole portion 21 into which the locking portion 15 is inserted. In other words, the plate portion 19 is provided with the hole portion 21 configured to receive the locking portion 15. An engagement surface 23 is provided at an edge of the hole portion 21 facing against an insertion direction of the terminal 13 to the terminal chamber 3. The engagement surface 23 is configured (formed) to be engaged with the locking portion 15 in a detachment direction of the terminal 13 from the terminal chamber 3.

A pair of chamfered portions 25, 25 is provided at edges of the hole portion 21 on both sides of the engagement surface 23. The chamfered portions 25, 25 are inclined toward an inside of the hole portion 21. A pair of supplemental engagement surfaces 27, 27 is provided at positions in the engagement surface 23 where the pair of chamfered portions 25, 25 is located. The supplemental engagement surfaces 27, 27 are configured to be engaged with the locking portion 15 in the detachment direction of the terminal 13 from the terminal chamber 3.

The plate portion 19 is provided with a locking projection 29. The locking projection 29 projects toward a locking lance 17 side from the plate portion 19. The locking projection 29 is provided with a projecting-engagement surface 31 where the engagement surface 23 is located. The projecting-engagement surface 31 is engaged with the locking portion 15 in the detachment direction of the terminal 13 from the terminal chamber 3.

As shown in FIGS. 1 to 10, the housing 5 is made of an insulating material such as a synthetic resin. The housing 5 is formed to be fitted to an opponent housing (not shown).

A lock arm 35 is flexibly (bendably) provided in the housing 5. The lock arm 35 includes a lock portion 33 for holding a fitting state between the housing 5 and an opponent housing. The lock arm 35 is flexibly provided in the housing 5. The lock portion 33 is engaged with a locked portion (not shown) provided in the opponent housing. With the engagement of the lock portion 33 with the locked portion, the fitting state between the opponent housing and the housing 5 is maintained.

An operation portion is provided on a free end side of the lock arm 35. By pressing the operation portion 37, the lock arm 35 is deflected, and the engagement between the lock portion 33 and the locked portion is released. That is, the fitting state between the opponent housing and the housing 5 can be released.

A plurality of terminal chambers 3 are provided in the housing 5. By fitting the housing 5 with a housing of an opponent connector, a plurality of terminals 13 accommodated in the terminal chambers 3 are electrically connected with opponent terminals (not shown) accommodated in the opponent housing.

The terminal chamber 3 is formed inside the housing 5 along the length direction of the housing 5, and a plurality (here, three) of terminal chambers 3 are arranged in parallel in the width direction of the housing S.

The terminal chamber 3 has an insertion opening 39 for inserting the terminal 13 therein. The insertion opening 39 is located at one end side of the terminal chamber 3 in the longitudinal direction thereof. The terminal chamber 3 has a connection opening 41 for inserting a male and tab-shaped connection portion terminal of the opponent terminal which is connected to the terminal 13 accommodated in the terminal chamber 3. The connection opening 41 is located at the other end of the terminal chamber 3 in the longitudinal direction.

In such terminal chambers 3, respective terminals 13 are accommodated from insertion openings 39.

The terminal 13 is formed by performing a punching process, a bending process, or the like on a single plate material made of the conductive material. The terminal 13 includes the wire-connecting portion 11 and the terminal-connecting portion 7, which are continuously formed within the single material.

The wire-connecting portion 11 includes a sheath-crimping portion 43 and a core-wire-crimping portion 45.

The sheath-crimping portion 43 is composed of a pair of caulking pieces and caulks the covering portion of the electric wire 9 at the end portion of the electric wire 9 connected to a power source or equipment.

By crimping the sheath-crimping portion 43 to the covering portion of the electric wire 9, the terminal 13 is fixed to the electric wire 9.

The core-wire-crimping portion 45 is composed of a pair of crimping pieces provided between the terminal-connecting portion 7 and the sheath-crimping portion 43. The crimping pieces crimp a core wire (conductive wire) at the end portion of the electric wire 9 exposed from a sheath of the electric wire 9.

The terminal 13 is electrically connected to the electric wire 9 by crimping the core-wire-crimping portion 45 to the core wire of the electric wire 9.

The terminal-connecting portion 7 is a female connecting portion formed in a box shape having a bottom wall, side walls, and the plate portion 19 as an upper wall. The terminal-connecting portion 7 is formed by folding the single material as described above, and the bottom wall continuously connected to the wire-connecting portion 11.

Inside the terminal-connecting portion 7, an elastic piece (not shown) is flexibly provided. The elastic piece (not shown) is continuously formed with the terminal-connecting portion 7, and has a contact portion (not shown) on a free end side of the elastic piece. The elastic piece (not shown) is deformable to bias with a predetermined force (i.e. biasing force).

The terminal-connecting portion 7 has an opening provided at one end side thereof in the longitudinal direction. A tab-like connecting portion of the opponent terminal is inserted into the inside of the terminal-connecting portion 7 through the opening. The tab-like connecting portion thus inserted comes into contact with the contact portion of the elastic piece by the biasing force of the elastic piece, whereby the terminal 13 and the opponent terminal are electrically connected to each other.

The terminal 13 having such a box-like terminal-connecting portion 7 is connected to the end of the electric wire 9 via the electric wire-connecting portion 11 and is inserted into the terminal chamber 3 from the insertion opening 39 of the terminal chamber 3. Accordingly, the electric wire 9 is drawn out of the housing 5 from the insertion opening 39.

The terminal 13 accommodated in the terminal chamber 3 is locked by the locking lance 17 provided in the terminal chamber 3, so that the terminal chamber 3 is prevented from falling out of the insertion opening 39.

When the terminal 13 is inserted into the terminal chamber 3, an end surface of the terminal-connecting portion 7 of the terminal 13 abuts against a wall portion provided with the connection opening 41 of the terminal chamber 3, whereby a further insertion of the terminal 13 is restricted.

The locking lance 17 is flexibly (bendably) provided in the terminal chamber 3. The locking lance 17 is flexible (bendable, deformable) in a vertical direction inside the terminal chamber 3. A base end side of the locking lance 17 is continuously formed with one of vertical walls of the terminal chamber 3. The free end side of the locking lance 17 extends toward the connection opening 41 with an inclination toward the inside of the terminal chamber 3.

The locking portion 15 is provided on the free end side of the locking lance 17. The locking portion 15 is continuously formed with the locking lance 17 and is protected toward the inside of the terminal chamber 3.

In other words, the locking portion 15 protrudes in a direction from a wall portion side of the terminal chamber 3 toward the inner side of the terminal chamber 3. The locking portion 15 includes a locking surface 47 and a pair of abutment portions 49, 49.

Figure 2:
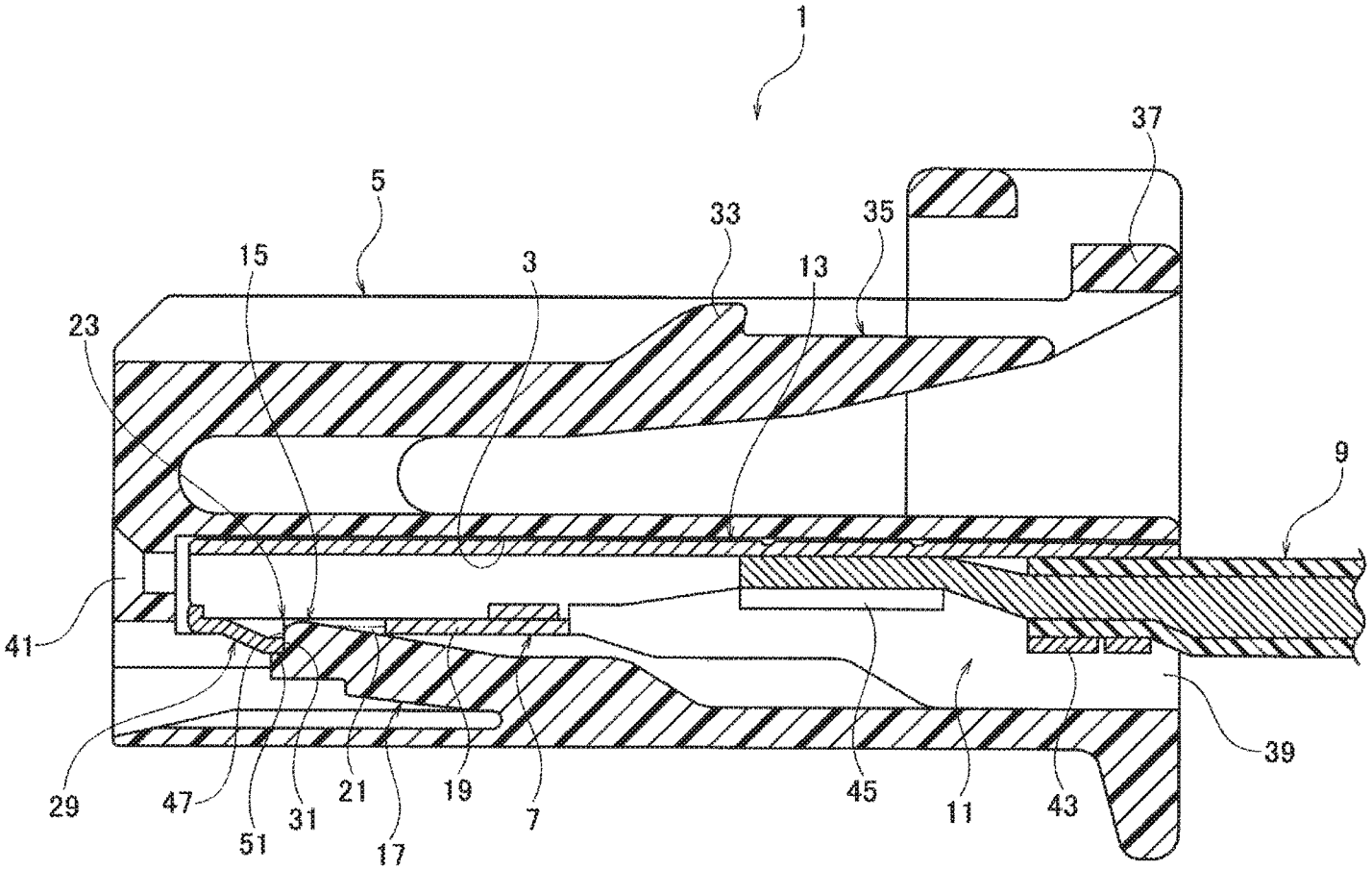
FIG. 2 is a cross-sectional view of the connector according to an embodiment of the present invention.
Figure 3:
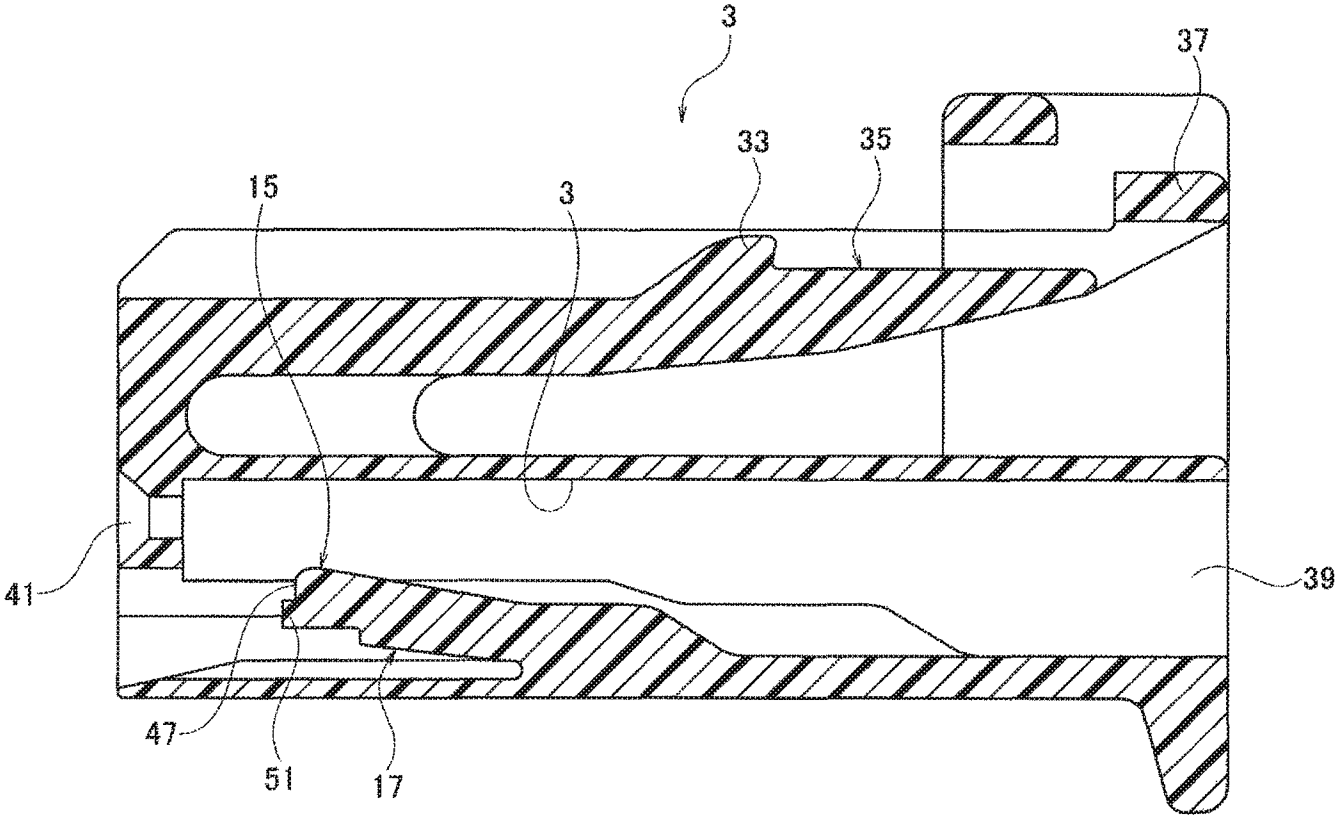
FIG. 3 is a sectional view of a housing of the connector according to an embodiment of the present invention.
Figure 4:
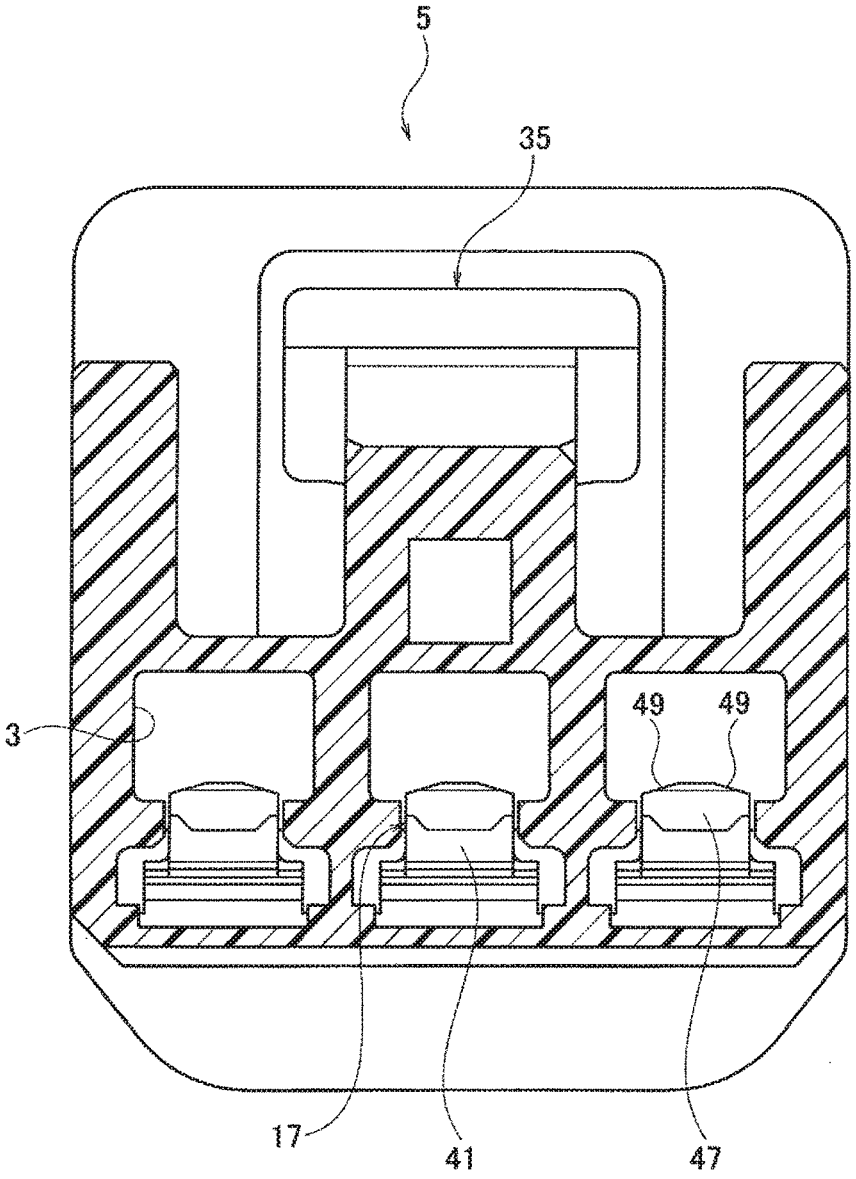
FIG. 4 is a front view of the housing according to an embodiment of the present invention with a cross section of a part of the housing.
Figure 5:
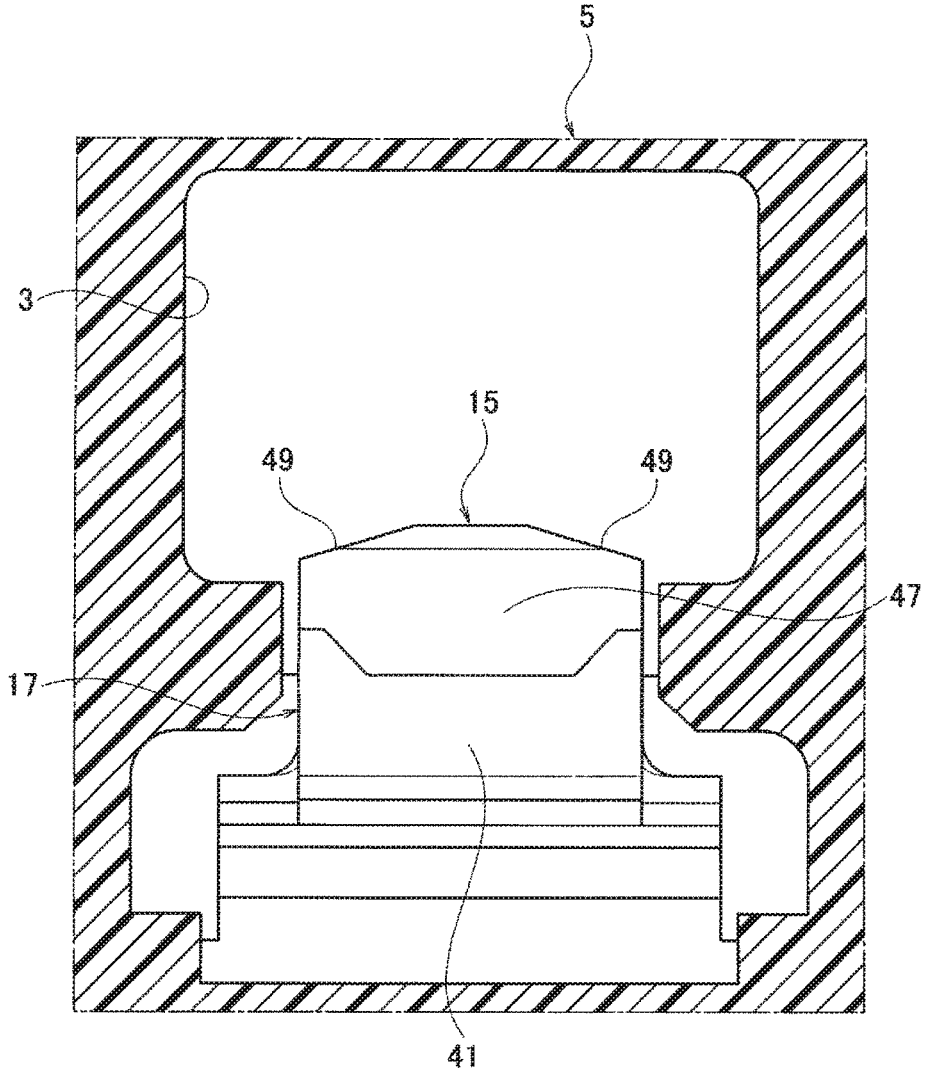
FIG. 5 is an enlarged view of a main part of FIG. 4.
Figure 6A:
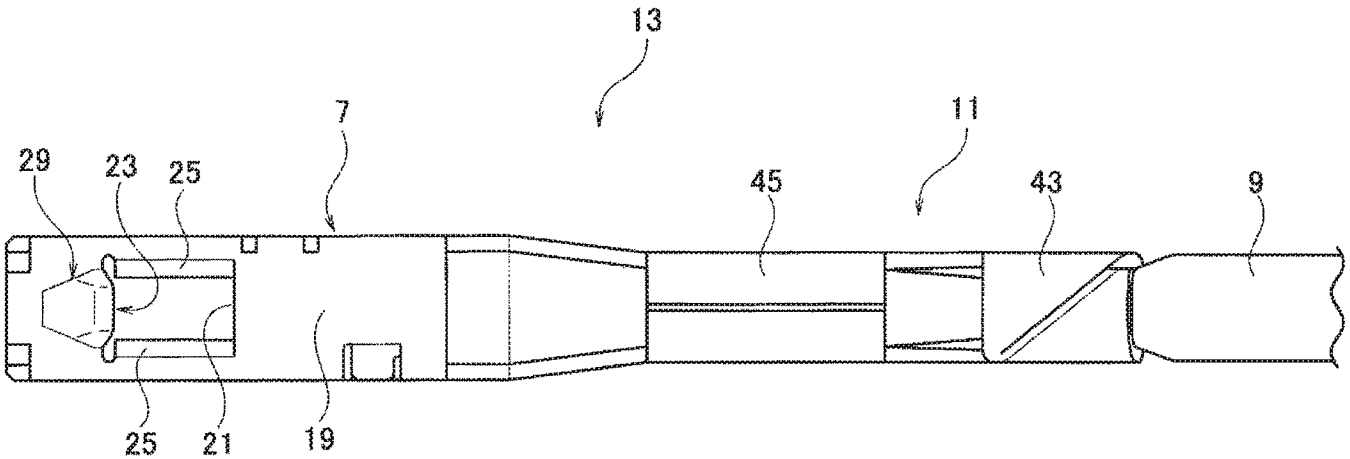
FIG. 6A is a top view of a terminal of the connector according to an embodiment of the present invention.
Figure 6B:
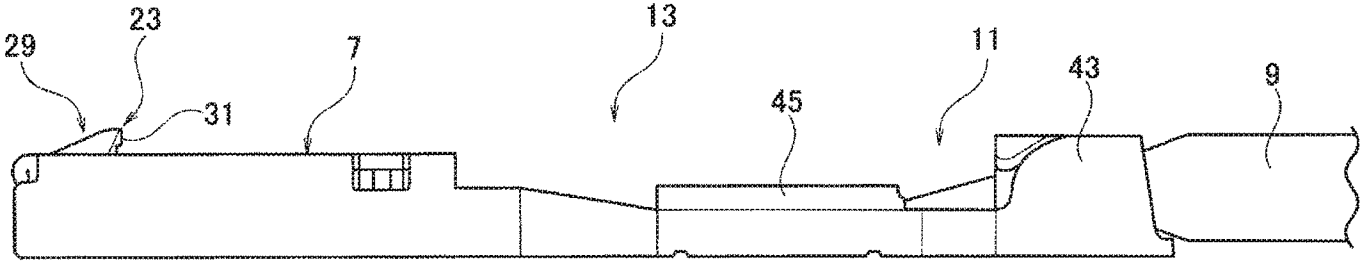
FIG. 6B is a side view of the terminal of the connector according to the embodiment of the present invention.
Figure 7:
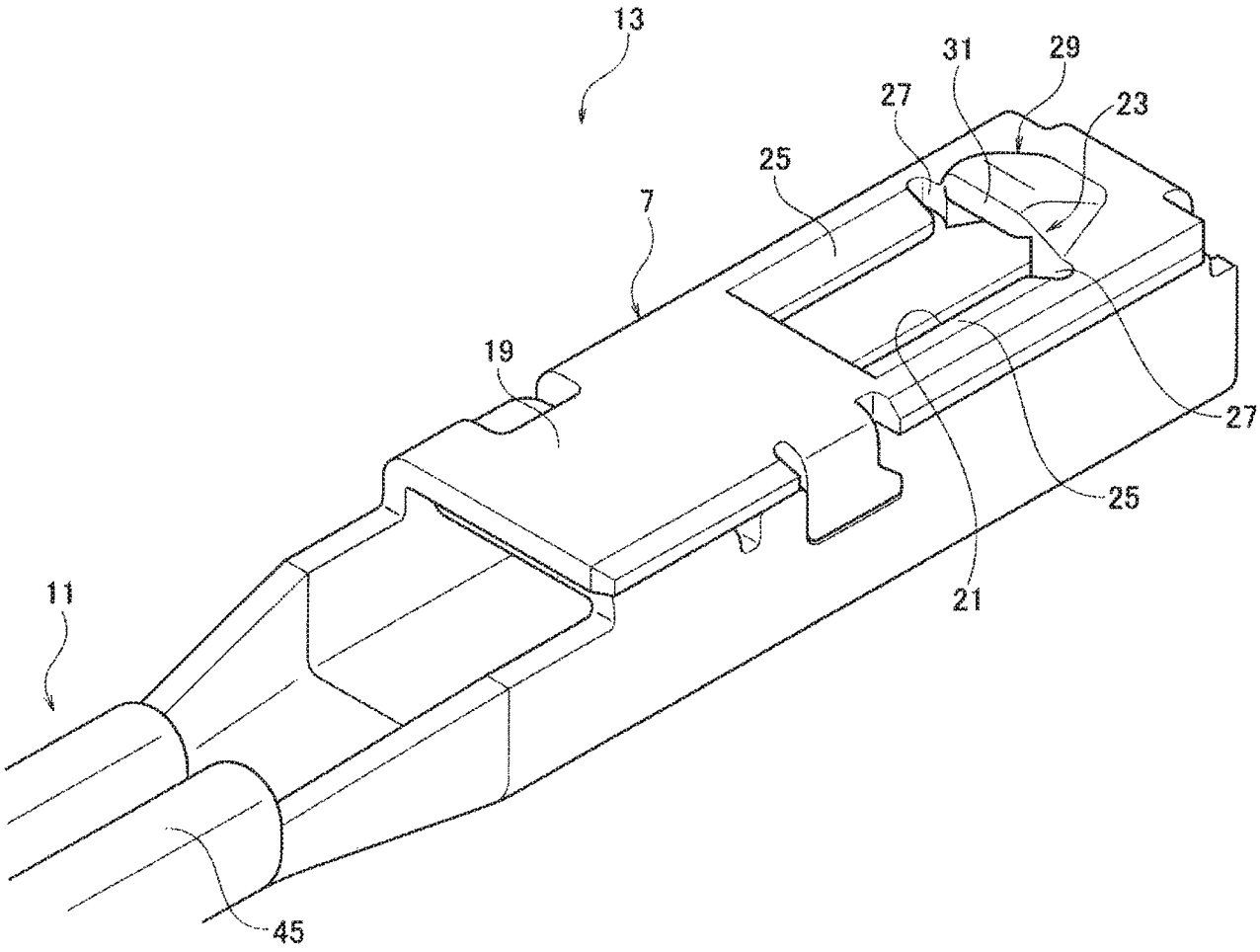
FIG. 7 is a perspective view of the terminal of the connector according to an embodiment of the present invention.
Figure 8:
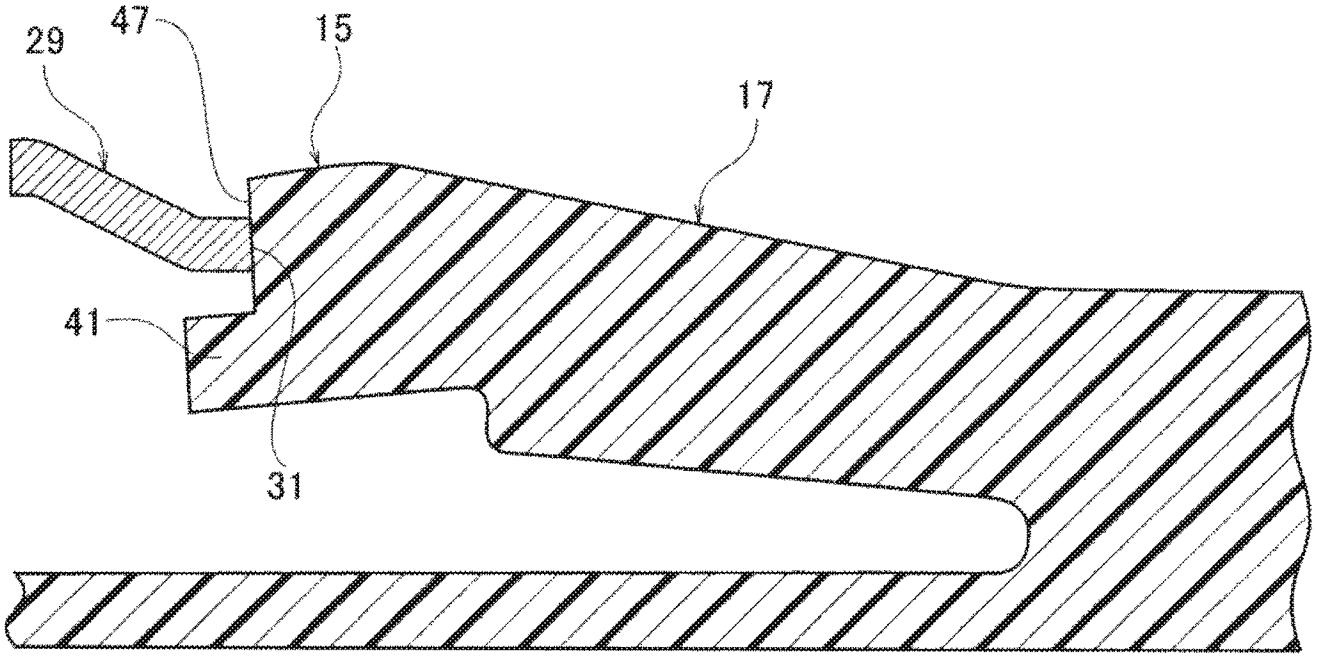
FIG. 8 is a cross-sectional view of a locking lance when a tensile force is applied to an electric wire of the connector according to an embodiment of the present invention.

The locking surface 47 is provided on a surface of the locking portion 15 on the free end side of the locking lance 17. As shown in FIG. 2, the locking surface 47 is formed on a left side surface of the locking lance 17.

The locking surface 47 extends from a tip of the locking portion 15 in a protruding direction, toward the base portion side of the locking portion 15 (an inner wall side of the terminal chamber 3). The locking surface 47 is slightly inclined in a drawing direction of the electric wire 9.

A releasing wall 51 is provided on a base side of the locking surface 47. The releasing wall 51 is continuously formed with the locking lance 17, and extends toward the connection opening 41 side. The terminal 13 can be withdrawn from the insertion opening 39 of the terminal chamber 3 by pressing the releasing wall 51 with a releasing jig (not shown) so that the locking lance 17 is bent.

The pair of abutment portions 49, 49 is provided on the tip end side in the projecting direction of the locking portion 15, and is disposed on both sides in a width direction of the locking portion 15.

The pair of abutment portions 49, 49 is formed as surfaces inclined from the tip of the locking portion 15 in the projecting direction, toward respective sides in the width direction of the locking portion 15 in other words, the abutment portions 49, 49 are formed as chamfered surfaces of corner portions located on both sides in the width direction.

When the terminal 13 is inserted into the terminal chamber 3 from the insertion opening 39, the terminal-connecting portion 7 of the terminal 13 slides on the locking portion 15, and bends the locking lance 17 downward.

The locking lance 17 thus bent is restored when the terminal 13 is positioned at a proper position in the terminal chamber 3. In the proper position, the locking portion 15 is inserted into the hole portion 21 provided in the plate portion 19 of the terminal-connecting portion 7 of the terminal 13, and the locking surface 47 is disposed to be engaged with the engagement surface 23.

The plate portion 19 of the terminal 13 and is formed in a flat plate and serves as an upper wall opposed to the locking lance 17 constituting the terminal-connecting portion 7.

The plate portion 19 is provided with the hole portion 21 into which the locking portion 15 is inserted, the engagement surface 23 to be engaged with the locking surface 47 of the locking portion 15, and the pair of chamfered portions 25, 25 to be engaged with the pair of abutment portions 49, 49.

The hole portion 21 is a rectangular hole penetrating the plate portion 19. The hole portion 21 is provided in the plate portion 19 and is located at a position where the hole portion faces the locking portion 15. When the locking lance 17 is restored, the locking portion 15 can be inserted.

The engagement surface 23 is provided at an edge portion on one end side in the longitudinal direction of the hole portion 21. In other words, the engagement surface 23 is provided at an edge portion of the hole portion 21 against an insertion direction of the terminal 13 into the terminal chamber 3.

The engagement surface 23 is engaged with the locking surface 47 of the locking portion 15 when the locking lance 17 is restored and the locking portion 15 is inserted into the hole portion 21. That is, the engagement surface 23 is arranged to face the locking surface 47 in the drawing direction of the electric wire 9, in other words, in the detaching direction of The engagement surface 23 is arranged to be able to engage with the locking surface 47 of the locking portion 15. When a tensile force is applied to the electric wire 9, the engagement surface 23 comes into contact with the locking surface 47, whereby it is possible to prevent the terminal 13 from coming off from the terminal chamber 3.

When the pulling force is applied to the electric wire 9 is strong while the engagement surface 23 and the locking surface 47 of the locking portion 15 are in contact with each other, the locking portion 15 side of the locking lance 17 may warp in the drawing direction of the electric wire 9 (see FIG. 8), and the engagement surface 23 may come into contact with a portion where a shearing area of the locking portion 15 becomes small. Here, the shearing area is a cross section of the locking portion 15 supposed when the locking portion 15 is sheared in the drawing direction of the electric wire 9.

If the engagement surface 23 would come into contact with the portion where the shearing area of the locking portion 15 is small as described above, the locking portion 15 might be damaged (e.g. broken). If the locking portion 15 is damaged, a terminal holding ability in the terminal chamber 3 decreases.

Therefore, in the present embodiment, the pair of chamfered portions 25, 25 is provided in the plate portion 19 of the terminal-connecting portion 7. The pair of chamfered portions 25, 25 regulates the warpage of the locking lance 17.

The pair of chamfered portions 25, 25 are respectively provided on the edge portions on both sides in the width direction of the hole portion 21, which are located on both sides of the engagement surface 23. The chamfered portions 25, 25 are inclined from the outside of the portion to the inside of the hole portion 21.

Figure 9:
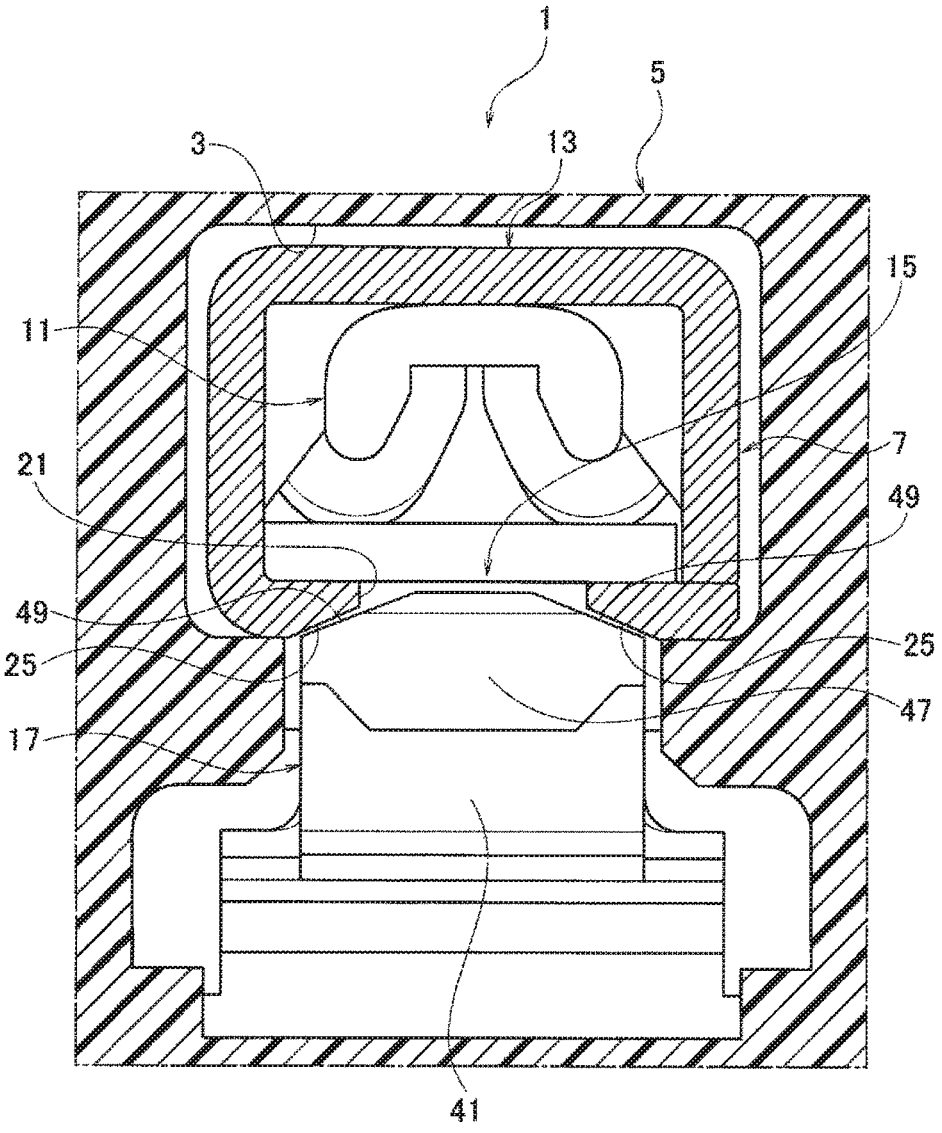
FIG. 9 is a cross-sectional view of the connector according to an embodiment of the present invention.

The chamfered portions 25, 25 are arranged to be engaged with the respective abutment portions 49, 49 when the locking lance 17 is restored and the locking portion 15 is inserted into the hole portion 21 (see FIG. 9).

The chamfered portions 25, 25 are engaged with the abutment portions 49, 49 of the locking portion 15 due to upward displacement of the locking portion 15 caused by the warpage of the locking lance 17, which is caused by the engagement between the locking surface 47 of the locking portion 15 and the engagement surface 23 of the terminal 13 when a tensile force is applied to the electric wire 9.

Figure 10:
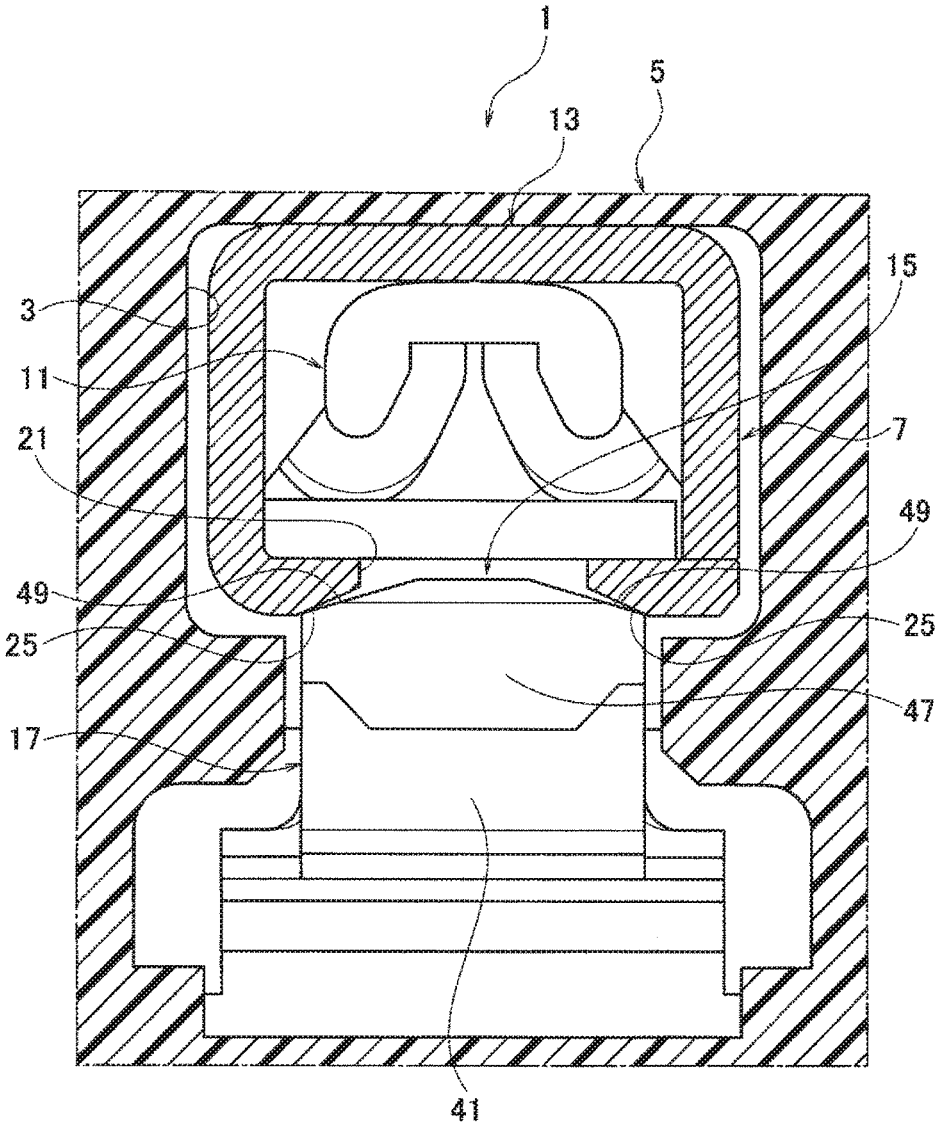
FIG. 10 is a cross-sectional view of the connector when a tensile force is applied to an electric wire of a connector according to an embodiment of the present invention.

By the engagement between the chamfered portions 25, 25 and the abutment portions 49, 49, the terminal-connecting portion 7 moves upward in the terminal chamber 3, and there is no gap between an outer surface of the terminal-connecting portion 7 and an inner surface of the terminal chamber 3 (see FIG. 10).

In this state, since the chamfered portions 25, 25 and the abutment portions 49, 49 are engaged with each other, the locking portion 15 side of the locking lance 17 cannot warp any more. Therefore, it is possible to prevent a reduction of the shearing area of the locking portion 15 against the tensile force of the electric wire 9.

Incidentally, the shearing area of the locking portion 15 against the tensile force of the electric wire 9 can be increased by increasing the abutment portion (i.e. abutment area) between the locking surface 47 of the locking portion 15 and the engagement surface 23 of the terminal 13. With the increase of the contacting area, it is possible to prevent the locking portion 15 from being damaged and to improve the terminal holding ability in the terminal chamber 3.

Therefore, in the present embodiment, the engagement surface 23 includes a pair of supplemental engagement surfaces 27, 27, and a projecting-engagement surface 31.

The pair of supplemental engagement surfaces 27, 2 7 is provided at parts in the engagement surface 23 where the pair of chamfered portions 25, 25 is located.

The pair of supplemental engagement surfaces 27, 27 is engaged with parts of the locking surface 47 of the locking portion 15, the parts being located at the pair of the abutment portions 49, 49, when the locking lance 17 is restored and the locking portion 15 is inserted into the hole portion 21. Therefore, the engagement surface 23 is arranged to face the locking surface 47 in the drawing direction of the electric wire 9, in other words, in the detaching direction of the terminal 13 from the terminal chamber 3.

The pair of supplemental engagement surfaces 27, 27 is arranged to be able to engage with the locking surface 47 of the locking portion 15. When a tensile force is applied to the electric wire 9, the supplemental engagement surfaces 27, 27 comes into contact with the locking surface 47, whereby it is possible to prevent the terminal 13 from coming off from the terminal chamber 3.

The pair of supplemental engagement surfaces 27, 27 is provided at parts in the engagement surface 23 where the pair of chamfered portions 25, 25, which is inclined toward an inside of the hole portion 21, is located. Accordingly, it is possible to expand the engagement surface 23 toward the both side in the width direction of the terminal-connecting portion The pair of supplemental engagement surfaces 27, 27 is provided at the parts where the pair of chamfered portions 25, 25 is located. Accordingly, by the abutment between the pair of chamfered portions 25, 25 and the pair of abutment portions 49, 49 when a tensile force is applied to the electric wire 9, the pair of supplemental engagement surfaces 27, 27 can be securely engaged with the parts of the locking surface 47 where the pair of abutment portions 49, 49, whereby the terminal 13 can be stably held in the terminal chamber 3.

With the provision of the pair of supplemental engagement surfaces 27, 27, it is possible to increase the abutment area of the engagement surface 23 of the terminal 13 and the locking surface 47 of the locking portion 15, and to prevent the locking portion 15 from being damaged, and to improve the terminal holding ability in the terminal chamber 3.

A projecting-engagement surface 31 is provided in a locking projection 29. The locking projection 29 is provided at the edge portion on one end side in the longitudinal direction of the hole portion 21, and projects from the edge portion toward a locking lance 17 side. In other words, the locking projection 29 is provided at the edge portion of the hole portion 21 against the insertion direction of the terminal 13 into the terminal chamber 3, and the projects from the edge portion toward the locking lance 17 side.

The projecting-engagement surface 31 is engaged with the locking surface 47 of the locking portion 15 when the locking lance 17 is restored and the locking portion 15 is inserted into the hole portion 21. That is, the engagement surface 23 is arranged to face the locking surface 47 in the drawing direction of the electric wire 9, in other words, in the detaching direction of the terminal 13 from the terminal chamber 3.

The projecting-engagement surface 31 is arranged to be able to engage with the locking surface 47 of the locking portion 15. When a tensile force is applied to the electric wire 9, the projecting-engagement surface 31 comes into contact with the locking surface 47, whereby it is possible to prevent the terminal 13 from coming off from the terminal chamber 3.

The projecting-engagement surface 31 is provided on the engagement surface 23 in the locking projection. 29 projecting from the plate portion 19 toward the locking lance 17 side.

Accordingly, it is possible to increase the engagement surface 23 in (toward) a height direction of the terminal-connecting portion 7.

The projecting-engagement surface 31 is provided on the locking projection 29 projecting toward the locking lance 17 side. Accordingly, when a tensile force is applied to the electric wire 9, the projecting-engagement surface 31 can be securely engaged with a part of the locking surface 47, which has a large thickness in the drawing direction of the electric wire 9, in other words, which has a large shearing area with respect to the tensile force, whereby the terminal 13 can be stably held in the terminal chamber 3.

With the provision of the projecting-engagement surface 31 together with the pair of supplemental engagement surfaces 27, 27, it is possible to further increase the abutment area of the engagement surface 23 of the terminal 13 and the locking surface 47 of the locking portion 15, to further increase the shearing area of the locking portion 15 with respect to the tensile force applied to the electric wire 9, to prevent the locking portion 15 from being damaged, and to further improve the terminal holding ability in the terminal chamber 3.

In the connector 1, the pair of chamfered portions 25, 25, each of which is inclined toward the inside of the hole portion 21, is provided. at the edge portions of the hole portion 21 on both sides of the engagement surface 23. Accordingly, the chamfered portions 25, 25 can prevent an unexpected warpage of the locking lance 17 when a tensile force is applied to the electric wire 9, and the locking portion 15 can be arranged in the part where the pair of chamfered portions 25, 25 of the engagement surface 23 is located.

The pair of supplemental engagement surfaces 27, 27 is provided at the positions in the engagement surface 23 where the pair of chamfered portions 25, 25 is located. The supplemental engagement surfaces 27, 27 are configured to be engaged with the locking portion 15 in the detachment direction of the terminal 13 from the terminal chamber 3. Accordingly, it is possible to increase the abutment area between the locking portion 15 and the engagement surface 23 of the terminal 13, and to increase the shearing area with respect to the tensile force applied to the electric wire 9.

Therefore, in the connector 1, it is possible to increase the contact area between the locking portion 15 and the engagement surface 23, and to prevent the locking portion 15 from being damaged by the shearing force caused by the tension of the electric wire 9, and to improve the terminal holding ability in the terminal chamber 3.

The locking projection 29 is provided with the projecting-engagement surface 31 where the engagement surface 23 is located. The projecting-engagement surface 31 is engaged with the locking portion 15 in the detachment direction of the terminal 13 from the terminal chamber 3. Accordingly, it is possible to further increase the contact area between the locking portion 15 and the engagement surface 23, and to further improve the terminal holding ability in the terminal chamber 3.

The engagement surface may include an inner surface of the edge portion of the hole portion against the insertion direction of the terminal toward the terminal chamber.

In this case, the engagement surface of the edge portion of the hole portion and the protrusion engagement surface may be formed into one continuous surface (i.e. single surface), otherwise may be formed into as independent surfaces (e.g. separated surfaces).

The pair of supplemental engagement surfaces may be formed as independent surface from the projecting-engagement surface. When the engagement surface is provided at the edge of the hole portion, the engagement surface at the edge of the hole portion, the pair of supplemental engagement surfaces, and the projecting-engagement surface may be formed into one continuous surface, otherwise may be formed into mutually independent surfaces.

What is claimed is:

1. A connector comprising:

a housing provided with a terminal chamber;

a terminal including a terminal-connecting portion and a wire-connecting portion, the terminal-connecting portion accommodated in the terminal chamber and configured to connect with an opponent terminal, the wire-connecting portion configured to connect with an end of an electric wire drawn out from the housing to an outside of the housing;

a locking lance flexibly provided in the terminal chamber, the locking lance including a locking portion on a free end side of the locking lance, the locking portion configured to lock the terminal-connecting portion;

a plate portion provided in the terminal-connecting portion, and arranged facing the locking lance;

a hole portion formed in the plate portion, configured to receive the locking portion thereinto;

an engagement surface provided at an edge of the hole portion facing against an insertion direction of the terminal to the terminal chamber, the engagement surface configured to be engaged with the locking portion in a detachment direction of the terminal from the terminal chamber;

a pair of chamfered portions provided at edges of the hole portion on both sides of the engagement surface, the chamfered portions inclined toward an inside of the hole portion; and a pair of supplemental engagement surfaces provided at parts of the engagement surface where the pair of chamfered portions is located, the supplemental engagement surfaces configured to be engaged with the locking portion in the detachment direction of the terminal from the terminal chamber.

2. The connector according to claim 1, wherein the plate portion is provided with a locking projection projecting toward a locking lance side, and the locking projection is provided with a projecting-engagement surface where the engagement surface is located, the projecting-engagement surface being engaged with the locking portion in the detachment direction of the terminal from the terminal chamber.

* * * * *